US010301046B2

(12) United States Patent
Mundt et al.

(10) Patent No.: US 10,301,046 B2
(45) Date of Patent: May 28, 2019

(54) PACKAGING WITH LAY-FLAT FLAPS

(71) Applicant: Apple Inc., Cupertino, CA (US)

(72) Inventors: Matthew Mundt, San Jose, CA (US); Bartley K. Andre, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 44 days.

(21) Appl. No.: 15/204,255

(22) Filed: Jul. 7, 2016

(65) Prior Publication Data

US 2018/0009586 A1 Jan. 11, 2018

(51) Int. Cl.

| | |
|---|---|
| ***B65D 73/00*** | (2006.01) |
| ***B65B 7/20*** | (2006.01) |
| ***B65B 5/04*** | (2006.01) |
| ***B65D 5/66*** | (2006.01) |

(52) U.S. Cl.

CPC ..... *B65B 7/20* (2013.01); *B65B 5/04* (2013.01); *B65D 5/6629* (2013.01); *B65D 5/6676* (2013.01)

(58) Field of Classification Search

CPC ..... B65D 75/14; B65D 75/04; B65D 5/22; B65D 5/0281; B65D 5/0035; B65D 5/6629; B65D 5/6676; B65B 5/04; B65B 7/20

USPC .... 206/472, 325, 321, 454, 591, 784, 525.1, 206/754, 521.1, 307, 307.1, 308.1, 745, 206/747, 751, 593, 594; 229/117.03, 126

See application file for complete search history.

(56) References Cited

U.S. PATENT DOCUMENTS

| | | | | |
|---|---|---|---|---|
| 2,951,583 | A * | 9/1960 | Sanford | B65D 5/5021 206/419 |
| 4,170,327 | A | 10/1979 | Bruml | |
| 4,413,726 | A | 11/1983 | Davidson | |
| 5,524,816 | A | 6/1996 | Zriny | |
| 5,871,147 | A * | 2/1999 | Smith | B65D 5/0281 206/485 |
| 6,685,026 | B1 * | 2/2004 | Hanna | B65D 5/5021 206/454 |
| 7,097,042 | B2 * | 8/2006 | Hsu | B65D 5/4801 206/305 |
| 7,293,695 | B2 | 11/2007 | Stier | |
| 7,748,527 | B2 * | 7/2010 | Wisecarver | B65D 5/5021 206/321 |
| 8,490,808 | B1 | 7/2013 | Snyder | |
| 2006/0086630 | A1 | 4/2006 | Cheong et al. | |

(Continued)

FOREIGN PATENT DOCUMENTS

| | | | |
|---|---|---|---|
| EP | 0086629 | A1 | 8/1983 |
| EP | 2404839 | A1 | 1/2012 |
| GB | 780199 | | 7/1957 |

*Primary Examiner* — Rafael A Ortiz

(74) *Attorney, Agent, or Firm* — Sterne, Kessler, Goldstein & Fox P.L.L.C.

(57) ABSTRACT

A package for an item is disclosed. The package includes an outer box and a first insert panel. The outer box includes a base panel and a first flap extending from the base panel. The first flap is configured to open and close the package. The first insert panel is disposed within the outer box. The first insert panel has a first end attached to the first flap and a second end disposed over the base panel. The first insert panel is configured to support an item within the package. The first insert panel is configured to move relative to the base panel when the first flap is opened. The first insert panel is configured to keep the first flap in an open position by friction between the first insert panel and the base panel.

20 Claims, 17 Drawing Sheets

(56) References Cited

U.S. PATENT DOCUMENTS

| | | | | |
|---|---|---|---|---|
| 2010/0243490 | A1* | 9/2010 | Wynalda | B65D 5/38 206/308.1 |
| 2014/0263442 | A1* | 9/2014 | Connerat | B67D 1/0078 222/105 |
| 2016/0167857 | A1* | 6/2016 | Liu | B65D 5/322 206/485 |

* cited by examiner

PACKAGING WITH LAY-FLAT FLAPS

FIELD

The described embodiments relate generally to packaging and specifically to packaging that has flaps that stay open after opening the packaging.

BACKGROUND

Packaging may be used, for example, to store, transport, protect and/or present products to consumers.

SUMMARY

The present disclosure details systems, apparatuses, and methods related to packaging that has flaps that stay open after opening the packaging. A package may include an outer box having a base panel and a first flap extending from the base panel and a first insert panel disposed within the outer box. The first flap may be configured to open and close the package. The first insert panel may have a first end attached to the first flap and a second end disposed over the base panel. The first insert panel may be configured to support an item within the package. The first insert panel may be configured to move relative to the base panel when the first flap is opened. The first insert panel may be configured to keep the first flap in an open position by friction between the first insert panel and the base panel.

In some embodiments, the package also includes a second flap extending from the base panel opposite the first flap and a second insert panel disposed within the outer box. In some embodiments, the second flap is configured to open and close the package. In some embodiments, the second insert panel has a first end attached to the second flap and a second end disposed over the base panel. In some embodiments, the second insert panel is configured to support an item within the package. In some embodiments, the second insert panel is configured to move relative to the base panel when the second flap is opened. In some embodiments, the second insert panel is configured to keep the second flap in an open position by friction between the second insert panel and the base panel. In some embodiments, the motion of the second insert panel when the second flap is opened is in an opposite direction as the motion of the first insert panel when the first panel is opened.

In some embodiments, the outer box has two side cushioning cells. In some embodiments, the first insert panel is disposed between the two side cushioning cells. In some embodiments, the two side cushioning cells each define a slot near the base panel. In some embodiments, the second end of the first insert panel comprises a tab disposed within the slot of each of the two side cushioning cells. In some embodiments, the slot guides the motion of the first insert panel and the second insert panel. In some embodiments, the two side cushioning cells comprise a rectangular prism. In some embodiments, the two side cushioning cells comprise a honeycomb material.

In some embodiments, the first end of the first insert panel is attached to the first flap via an adhesive. In some embodiments, the package also includes a cushioning cell disposed on a side portion of the first flap adjacent to the first insert panel. In some embodiments, the first flap comprises a side portion forming a side of the outer box and a top portion forming a top of the outer box. In some embodiments, the first end of the first insert panel is attached to the first flap at the side portion. In some embodiments, the material of the package causes the first flap to be naturally biased toward a closed position. In some embodiments, the friction between the first insert panel and the base panel contributes to overcoming the bias to keep the first flap in the open position.

In some embodiments, a package includes an outer box having a base panel and two insert panels disposed over the base panel and attached to the outer box. In some embodiments, the two insert panels move relative to the base panel when the package transitions between a first position wherein the package is closed and a second position wherein the package is open. In some embodiments, there is a larger gap between the two insert panels in the second position than in the first position.

In some embodiments, there is no gap between the two insert panels in the first position. In some embodiments, the package also includes an item disposed within the package. In some embodiments, the item is disposed across the gap. In some embodiments, a weight of the item keeps the two insert panels from moving relative to each other in the absence of applied outside force, thereby keeping the package from moving between closed and open.

In some embodiments, the two insert panels each comprise a width that is equal to a width of an interior of the package. In some embodiments, the two insert panels comprise tabs. In some embodiments, the outer box defines slots that receive the tabs. In some embodiments, the tabs move within the slots when the two insert panels move between the first position and the second position.

In some embodiments, a method of packaging a product includes placing an item across a gap between two movable panels of a package. In some embodiments, each of the panels forms a linkage with a flap of the package. In some embodiments, the flaps of the package are open. In some embodiments, the method includes reducing the gap by moving the panels toward each other by closing the flaps of the package. In some embodiments, the weight of the item contributes to maintaining the flaps in a closed position, by contributing to a frictional force between the movable panels and a base panel.

In some embodiments, the method includes increasing the gap by moving the panels away from each other by opening the flaps of the package. In some embodiments, the weight of the item contributes to maintaining the flaps in an open position, by contributing to a frictional force between the movable panels and the base panel.

In some embodiments, the method includes attaching the two movable panels to the flaps of the package via an adhesive to form the linkage.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
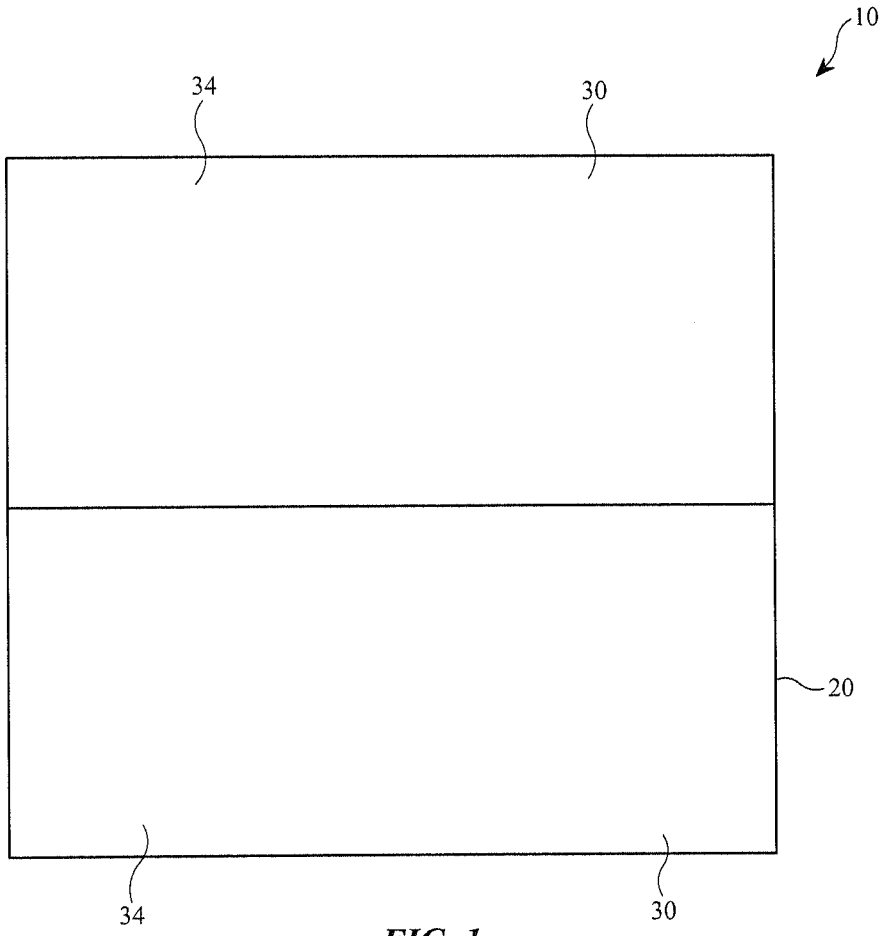
FIG. 1 shows a top view of a package in a closed configuration according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Packaging may be used, for example, to store, transport, protect and/or present products to consumers. Because the consumer is primarily concerned with the product (i.e., an item within the package), it is desirable to have packaging that adequately protects the product but does not interfere with the presentation of the product. Furthermore, because the packaging will likely be discarded, it is desirable to provide packaging made of environmentally friendly materials. In this regard, environmentally friendly materials, such as cardboard, result in packaging flaps that have the tendency to stay in the closed position, thus interfering with the product within the package. Accordingly, improvements in packaging are desirable.

The following disclosure relates generally to packaging, and more specifically, to packaging that does not interfere with the presentation of the product within the packaging. In some embodiments of the present invention, the packaging may be used for any product. In some embodiments, the packaging is used for heavy products, but lighter products may also be packaged according to the features disclosed herein. The packaging disclosed herein may be used in a variety of package sizes.

In some embodiments, a package includes an outer box and one or more inserts. The outer box may form the majority of the package, including a base and one or more flaps that open and close to open and close the package. An insert may be attached to the outer box such that the insert moves relative to the outer box when the flaps open and close.

For example, an insert may be attached at one end to a portion of the flap with the other end resting over the base of the outer box. When the flap opens, the insert moves partially away from its position over the base when the package is closed. Because the movement of the flap is tied to the movement of the insert, the weight of the product within the package may keep the flap open, thus reducing the interference of the flap with the view of the package. In some embodiments, the weight of the package is enough to hold the flap open via the insert, but not so great that an individual cannot easily close the flap when desired. In this regard, the flap may be considered a lay-flat flap, even if the flap does not lay entirely flat.

In some embodiments, two flaps are used with two inserts. The two flaps may be disposed on opposite sides. The two inserts move away from each other when the package is opened via the two flaps. The weight of the product within the package may keep both flaps open via the two inserts.

In some embodiments, the outer box and/or the inserts provide cushioning cells on the sides of the package. The cushioning cells may assist in protecting the package and also facilitate movement of the inserts and closure of the package, among other things. For example, a cushioning cell of the outer box may include slots to receive a portion of the inserts. The slots may define the possible movement of the inserts. A cushioning cell of the outer box may also include slots to receive a portion of the flaps when the package is closed.

These and other embodiments are discussed below with reference to the figures. However, those skilled in the art will readily appreciate that the detailed description given herein with respect to these figures is for explanatory purposes only and should not be construed as limiting.

Figure 2:
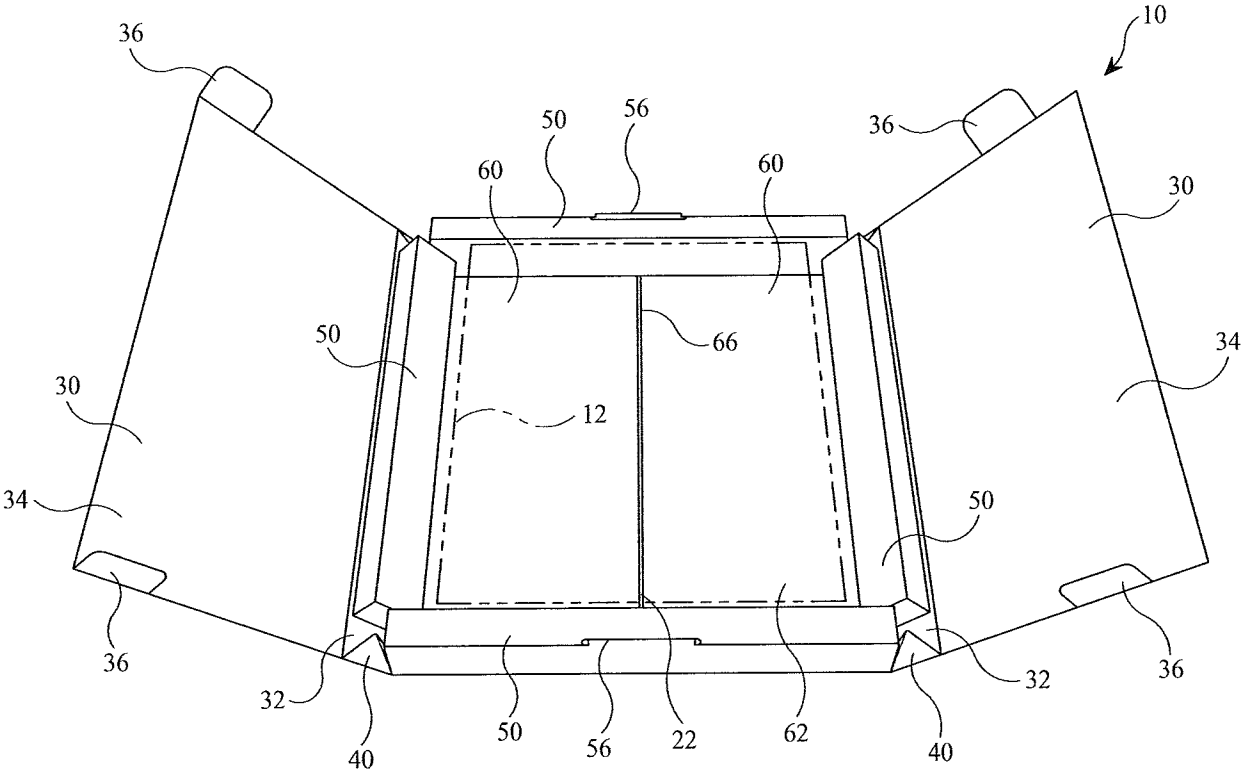
FIG. 2 shows a package in an open configuration according to some embodiments.
Figure 3:
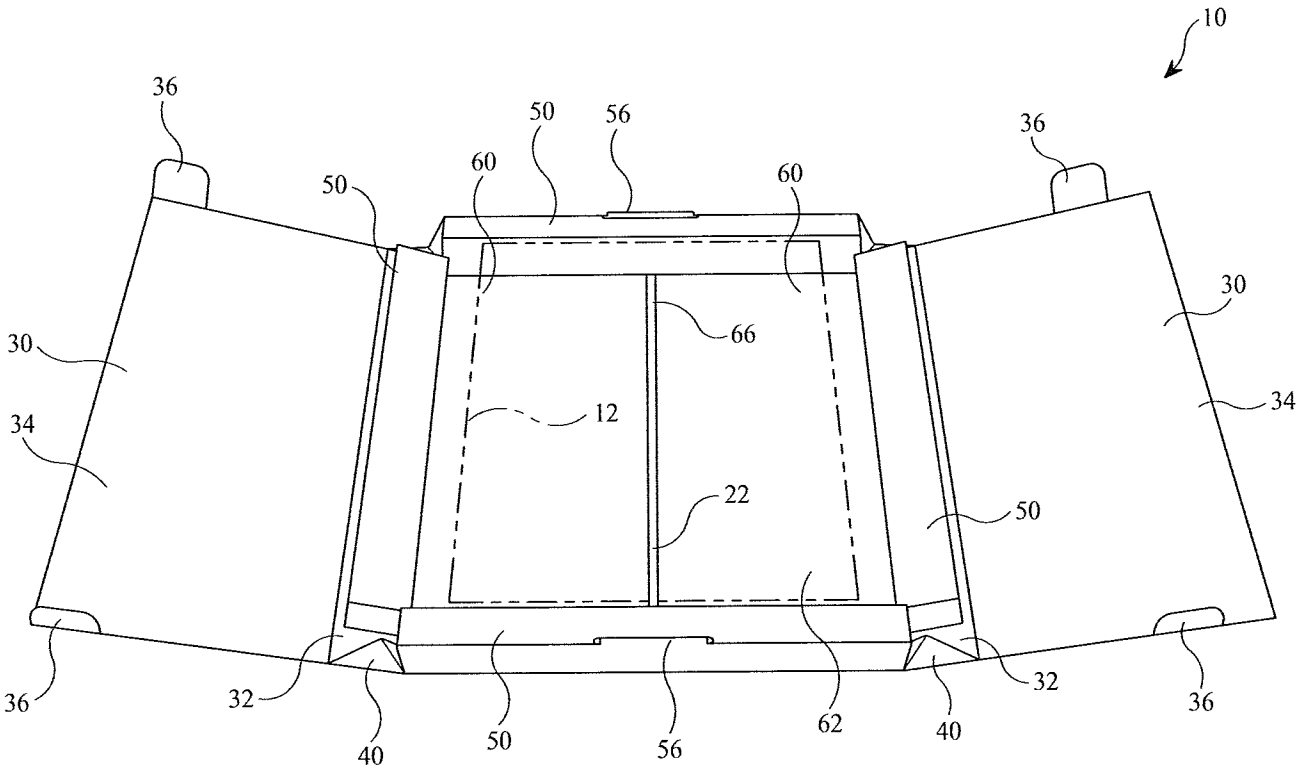
FIG. 3 shows a package in an open configuration according to some embodiments.
Figure 4:
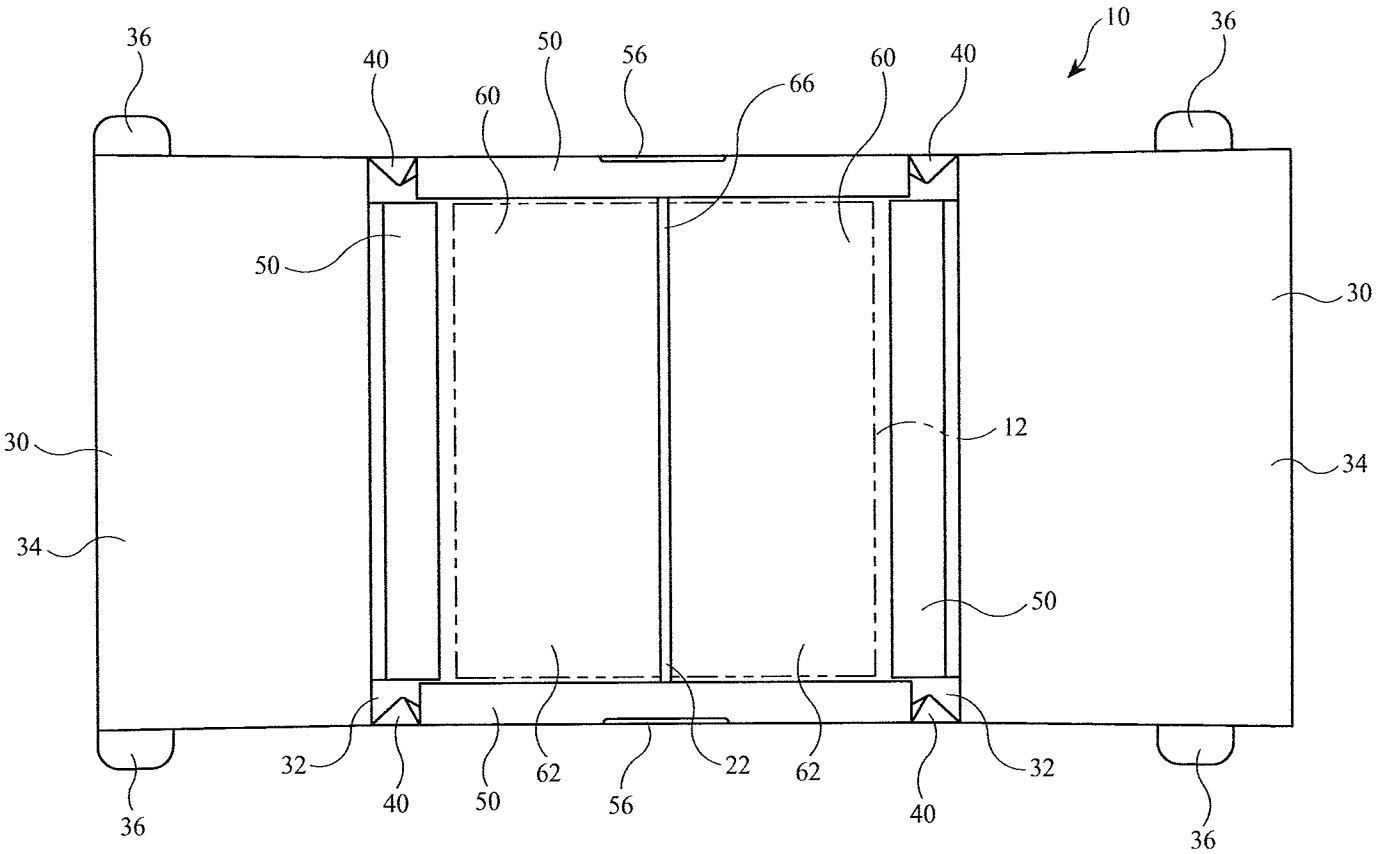
FIG. 4 shows a top view of a package in an open configuration according to some embodiments.

A package 10, as shown, for example, in FIGS. 1-4, may be used to store, transport, protect, and/or present a product or other item 12. In FIG. 1, package 10 is shown in a closed configuration. In FIGS. 2-4, package 10 is shown in an open configuration. In some embodiments, package 10 includes an outer box 20 and one or more inserts 60. In some embodiments, two inserts 60 may be used.

Outer box 20 may form the majority of package 10. In some embodiments, outer box 20 includes a base 22, one or more flaps 30, and one or more cushioning cells 50. Base 22 may form the bottom of package 10. As shown in FIG. 4, a majority of base 22 may be covered by inserts 60 with a gap 66 between inserts 60. In some embodiments, flaps 30 extend continuously from base 22. In some embodiments, two flaps 30 extend continuously from base 22 on opposite sides.

As shown, in FIGS. 2 and 3, the opening and closing of flaps 30 control the movement of inserts 60 and the gap 66 between inserts 60 due to a linkage between flaps 30 and inserts 60. Package 10 in FIG. 3 is open farther than package 10 in FIG. 2 (i.e., flaps 30 are farther from the closed configuration). As a result, inserts 60 are farther apart from each other, thus increasing the width of gap 66. In some embodiments, the width of gap 66 is zero when package 10 is closed. In some embodiments, item 12 may affect the movement of inserts 60 and flaps 30. For example, item 12 may be placed in package 10 across gap 66 between inserts 60. In some embodiments, the weight of item 12 contributes to maintaining the flaps in a closed position or an open position by contributing to a frictional force between the movable panels and a base panel.

In some embodiments, flaps 30 comprise a side portion 32 and a top portion 34. Side portion 32 may form a side of package 10. Top portion 34 may form a top of package 10 when package 10 is in a closed position (see FIG. 1). In some embodiments, flaps 30 comprise a tab 36. For example, as shown in FIG. 4, each flap 30 comprises two tabs 36 that may assist in closing package 10, as discussed in more detail below. In some embodiments, each flap 30 may be differently. For example, one flap 30 may only extend to the middle of package 10 in the closed configuration, while the other flap 30 may extend beyond the middle of package 10 in the closed configuration. This allows for flaps 30 to overlap in the closed configuration. Because flaps 30 may be of different length, tabs 36 on one flap 30 may be located in a different portion of flap 30 than tabs 36 on the other flap 30, as shown, for example, in FIG. 4.

In some embodiments, outer box 20 may comprise cushioning cells 50 disposed on those sides of base 22 that do not extend continuously into flaps 30. In some embodiments, cushioning cell 50 forms a side of package 10. In some embodiments, cushioning cell 50 protects item 12 from damage (e.g., if package 10 is dropped). In some embodiments, cushioning cell 50 includes a material 55 disposed within a cavity 54 of cushioning cell 50. In some embodiments, material 55 comprises a honeycomb material, as shown, for example, in FIG. 9. In some embodiments, material 55 contributes to the cushioning effect of cushioning cell 50.

In some embodiments, cushioning cell 50 comprises slots 56. In some embodiments, slots 56 are disposed at a top portion of cushioning cell 50. For example, slots 56 may be disposed at an outer top portion of cushioning cell 50, as shown in FIG. 4. In some embodiments, slots 56 are configured to receive tabs 36 to assist in closing package 10. Slots 56 may be disposed anywhere along the length of cushioning cell 50. In some embodiments, slots 56 are disposed in the middle along the length of cushioning cell 50. In some embodiments, slots 56 are shaped and sized to receive two tabs 36 (i.e., one from each flap 30). Tabs 36 may be positioned along flaps 30 such that when package 10 is in a closed position, tabs 36 will align with slots 56.

In some embodiments, cushioning cell 50 further comprises slots 58. In some embodiments, slots 58 are disposed at a bottom portion of cushioning cell 50 adjacent to base 22. In some embodiments, slots 58 are configured to interact with a portion of inserts 60, as discussed in more detail below.

In some embodiments, outer box 20 comprises gussets 40. For example gussets 40 may be disposed at each corner of package 10. In some embodiments, gussets 40 fold in between adjacent cushioning cells 50. In some embodiments, gussets 40 fold in between cushioning cell 50 and side portion 32. In some embodiments, gussets 40 contribute to the look and feel of package 10. For example, gusset 40 may be visible to a user when package 10 is closed instead of an interior, unfinished edge of the material that forms outer box 20. In addition, gussets 40 may also contribute to protecting item 12 within package 10.

Figure 5:
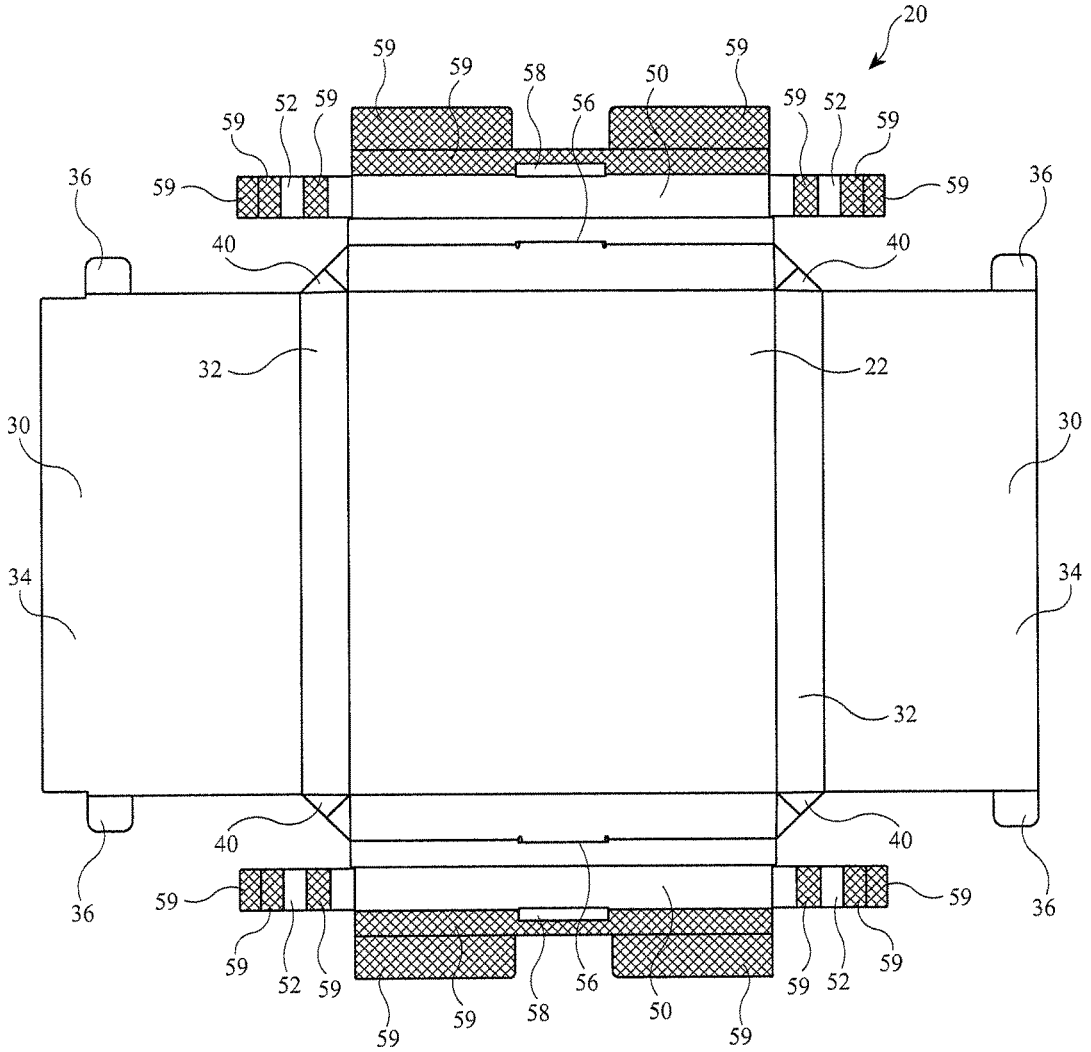
FIG. 5 shows a layout of a portion of a package according to some embodiments.

In some embodiments, outer box 20 is formed from a single layout, as shown, for example, in FIG. 5. In some embodiments, the layout that forms outer box 20 comprises adhesive portions 59 that partially form cushioning cells 50. The indication of an adhesive portion 59 in FIG. 5 is not an indication that a particular side of the indicated portion is the side where adhesive is applied. Rather the indication of an adhesive portion 59 means that adhesive may be applied on either side of adhesive portion 59 or both sides of adhesive portion 59.

In some embodiments, adhesive portions 59 are provided with a double-sided adhesive. For example, adhesive portions 59 may be provided with a double-sided adhesive that sticks to that portion of the layout. The opposite side of the double-sided adhesive may include a covering (e.g., paper) that may be peeled off to expose the adhesive. The double-sided adhesive may then stick to another portion of the layout as cushioning cells 50 are formed. In some embodiments, adhesive portions 59 are merely marked as such for a manufacturer to apply adhesive when forming package 10. The process of forming package 10, and outer box 20 specifically, out of the layout is discussed in more detail below.

Inserts 60 may form an interior portion of package 10. In some embodiments, inserts 60 are configured to attach to outer box 20. In some embodiments, inserts 60 are functionally coupled with flaps 30. For example, in some embodiments, inserts 60 each include a cushioning cell 50. Thus, while outer box 20 provides cushioning cells 50 disposed on those sides of base 22 that do not extend continuously into flaps 30, inserts 60 may provide cushioning cells 50 disposed adjacent to side portions 32 of flaps 30. In some embodiments, cushioning cells 50 of inserts 60 are attached to side portions 32. For example, an adhesive may be used to attach cushioning cells of inserts 60 to side portions 32.

Thus, in some embodiments, each side of package 10 has a cushioning cell 50. In some embodiments, cushioning cells 50 frame item 12 as package 10 is opened. In some embodiments, after package 10 is opened, cushioning cells 50 of inserts 60 are spaced from item 12, thus providing room for a user to lift item 12 out of package 10.

Cushioning cells 50 of inserts 60 are similar to the cushioning cells 50 of outer box 20 described above. For example, cushioning cells of inserts 60 may form a side of package 10 and may protect item 12 from damage (e.g., if package 10 is dropped). Further, cushioning cells 50 of inserts 60 may include a material 55 disposed within a cavity 54 of cushioning cell 50, such as a honeycomb material, as shown, for example, in FIG. 9. Such a material 55 may contribute to the cushioning effect of cushioning cell 50. Cushioning cells 50 of inserts 60 may differ from cushioning cells 50 of outer box 20 in that cushioning cells 50 of inserts 60 do not have slots 56 or slots 58.

Figure 6:
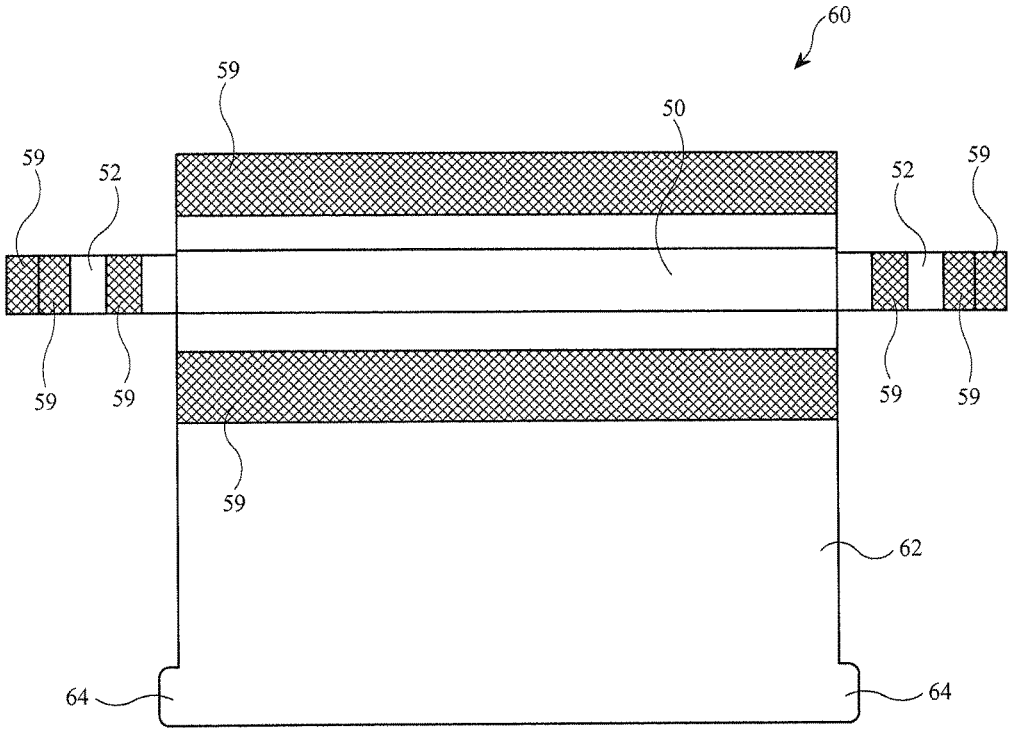
FIG. 6 shows a layout of a portion of a package according to some embodiments.

In some embodiments, inserts 60 comprise one or more tabs 64 disposed on an opposite end from cushioning cell 50 of insert 60, as shown, for example, in FIG. 6. In some embodiments, tabs 64 extend into slots 58 when package 10 is made. In some embodiments, the length of slots 58 sets a boundary on how much insert 60 can move relative to outer box 20. For example, insert 60 can only move until tab 64 abuts an end of slot 58. Because insert 60 is attached to flaps 30 (e.g., at side portions 32), insert 60 moves and tab 64 slides within slot 58 when flaps 30 are opened and closed. Thus, the movement of flaps 30 and inserts 60 are tied to one another due to the mechanical link between flaps 30 and inserts 60 (i.e., portion of insert 60 adhered to portion of flap 30).

In some embodiments, tabs 64 contribute to inserts 60 moving relative to outer box 20. For example, tabs 64 may prevent inserts 60 from warping because tabs 64 are disposed within slots 58. This configuration may help the sliding motion of insert 60 remain consistent over time. In some embodiments, a coating may be applied to tabs 64 that contribute to a smoother sliding motion.

In some embodiments, two inserts 60 are used as interior portions of package 10, as shown, for example, in FIG. 4. Each insert 60, in some embodiments, is a mirror image of the other. In some embodiments, inserts 60 comprise a supporting portion 62. Supporting portions 62 may cover a majority of base 22 of outer box 20. Thus, item 12 rests on supporting portions 62. In some embodiments, the two inserts 60 may form a gap 66 between each supporting portion 62. Gap 66 may have a larger width when package 10 is in an open configuration than when package 10 is in a closed configuration.

In some embodiments, each insert 60 is formed from a single layout, as shown, for example, in FIG. 6. In some embodiments, the layout that forms each insert 60 comprises adhesive portions 59 that partially form cushioning cells 50. The indication of an adhesive portion 59 in FIG. 6 is not an indication that a particular side of the indicated portion is the side where adhesive is applied. Rather the indication of an adhesive portion 59 means that adhesive may be applied on either side of adhesive portion 59 or both sides of adhesive portion 59.

In some embodiments, adhesive portions 59 are provided with a double-sided adhesive. For example, adhesive portions 59 may be provided with a double-sided adhesive that sticks to that portion of the layout. The opposite side of the double-sided adhesive may include a covering (e.g., paper) that may be peeled off to expose the adhesive. The double-sided adhesive may then stick to another portion of the layout as cushioning cells 50 are formed. In some embodiments, adhesive portions 59 are merely marked as such for a manufacturer to apply adhesive when forming package 10. The process of forming package 10, and inserts 60 specifically, out of the layout is discussed in more detail below.

In some embodiments, package 10 may be formed from three layouts. In some embodiments, package 10 may be formed from only two layouts. More layouts may be used in some embodiments. To make package 10, for example, each layout may be cut from a sheet having multiple layouts. In some embodiments, each layout may be die cut. In some embodiments, layouts are made of a corrugated material, such as cardboard (e.g., E-flute corrugated cardboard). In some embodiments, the layouts have a white finish over the corrugated material. In some embodiments, the edges of the layouts may be pre-crushed to reduce the amount of corrugate visible to a user in package 10. Pre-crushing the edges of tabs 64 may contribute to a smoother sliding motion of inserts 60. In some embodiments, the layouts include markings or indents where the layout should be folded to form package 10. For example, the layout may be pre-scored and pre-folded before assembly.

With this configuration of package 10, flaps 30 are lay-flat flaps even though the material, such as cardboard, of flaps 30 tends to return to the closed position. Specifically, the weight of item 12 within package 10 may overcome the tendency of flaps 30 to close and thus interfere with the view of item 12. In some embodiments, the weight of item 12 is between 5 and 15 pounds. For example, the weight of item 12 is 12 pounds.

Figure 7:
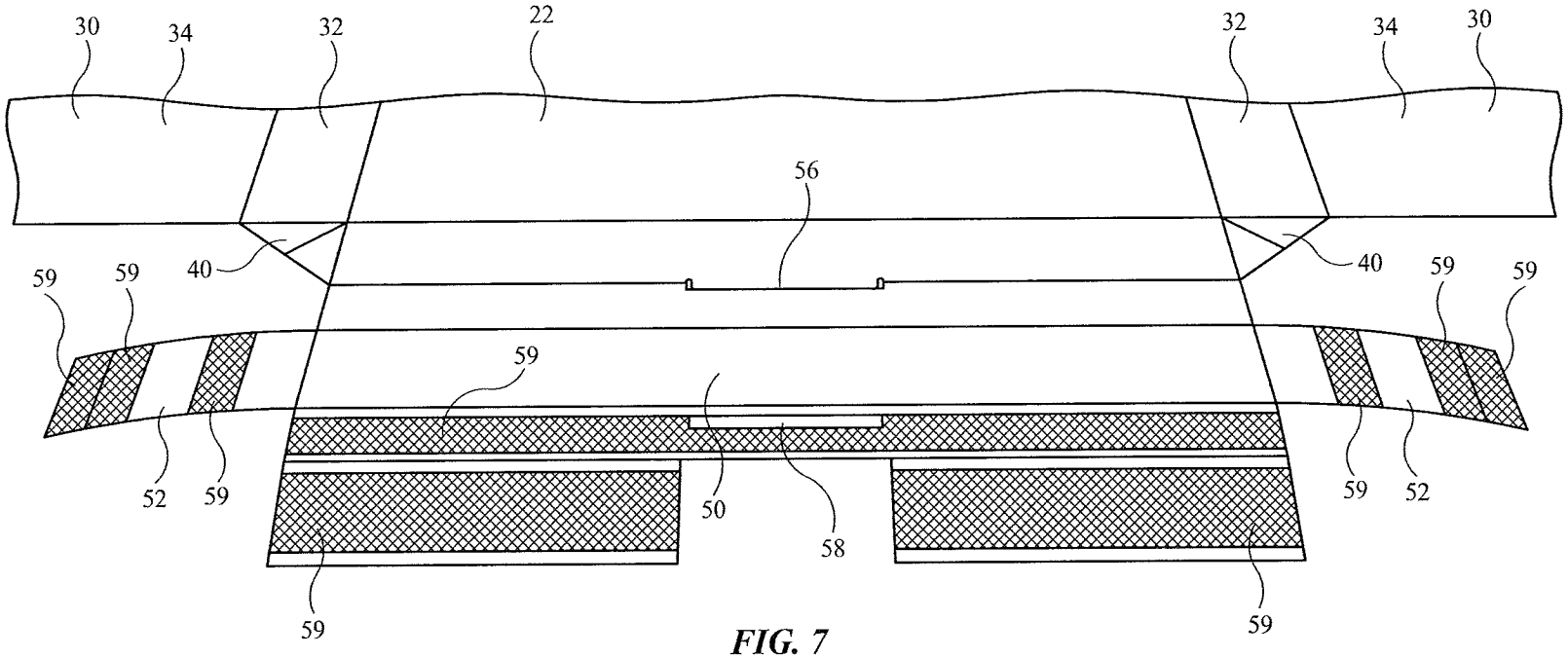
FIG. 7 shows a layout of a portion of a package according to some embodiments.
Figure 8:
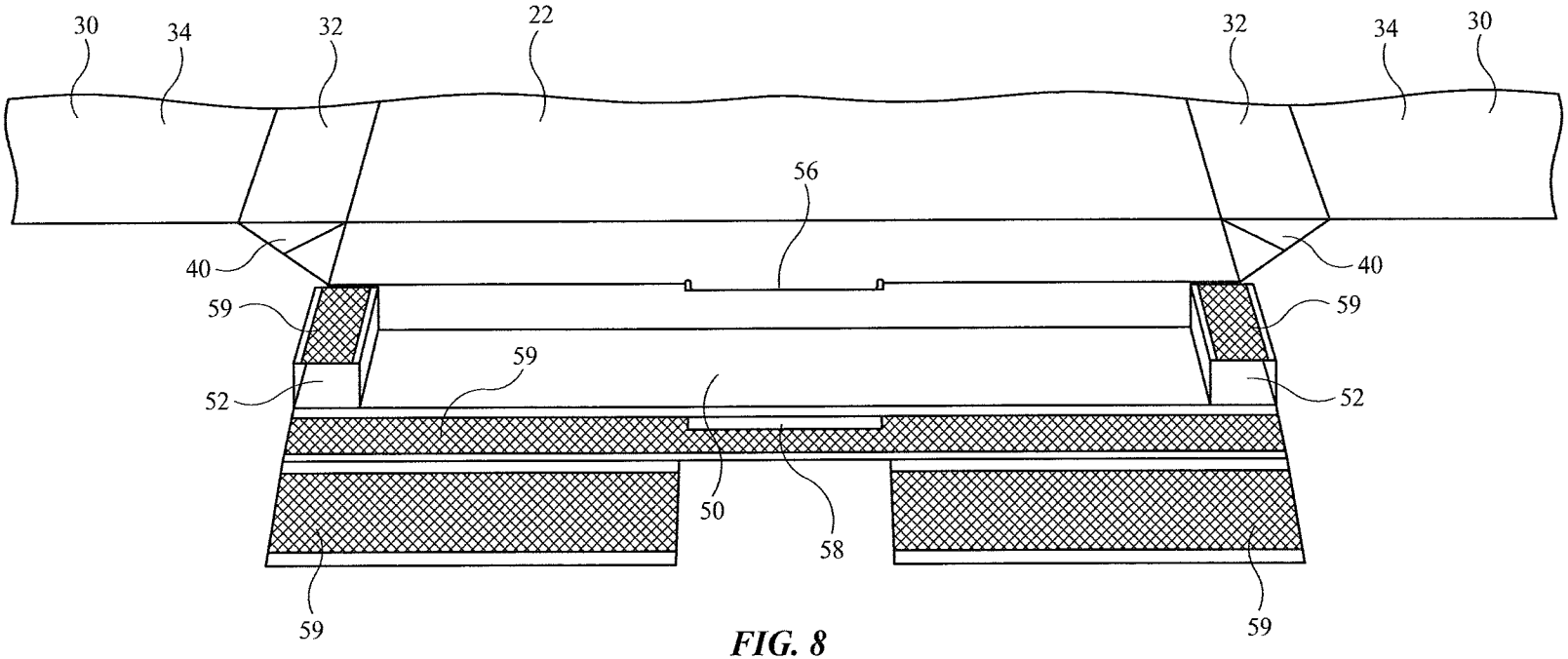
FIG. 8 shows a portion of a partially-assembled package according to some embodiments.
Figure 9:
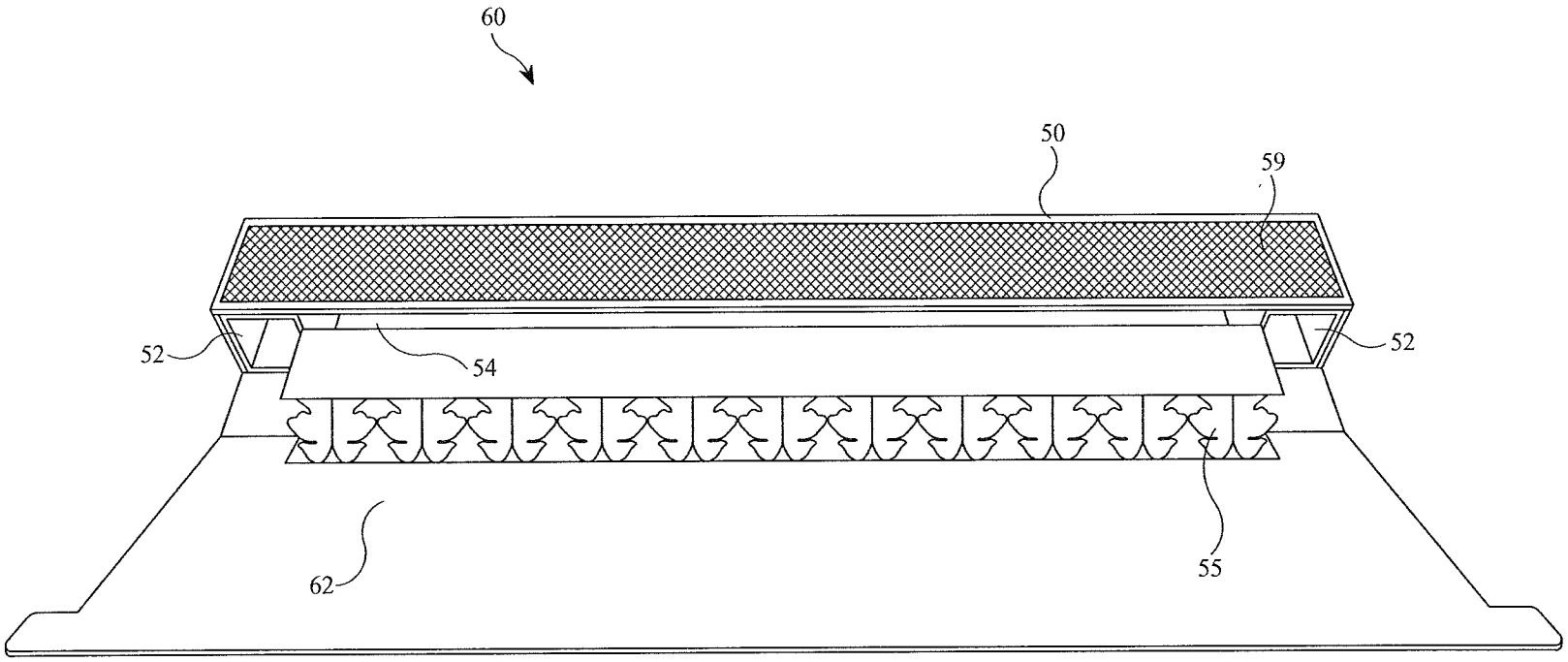
FIG. 9 shows a portion of a partially-assembled package according to some embodiments.
Figure 10:
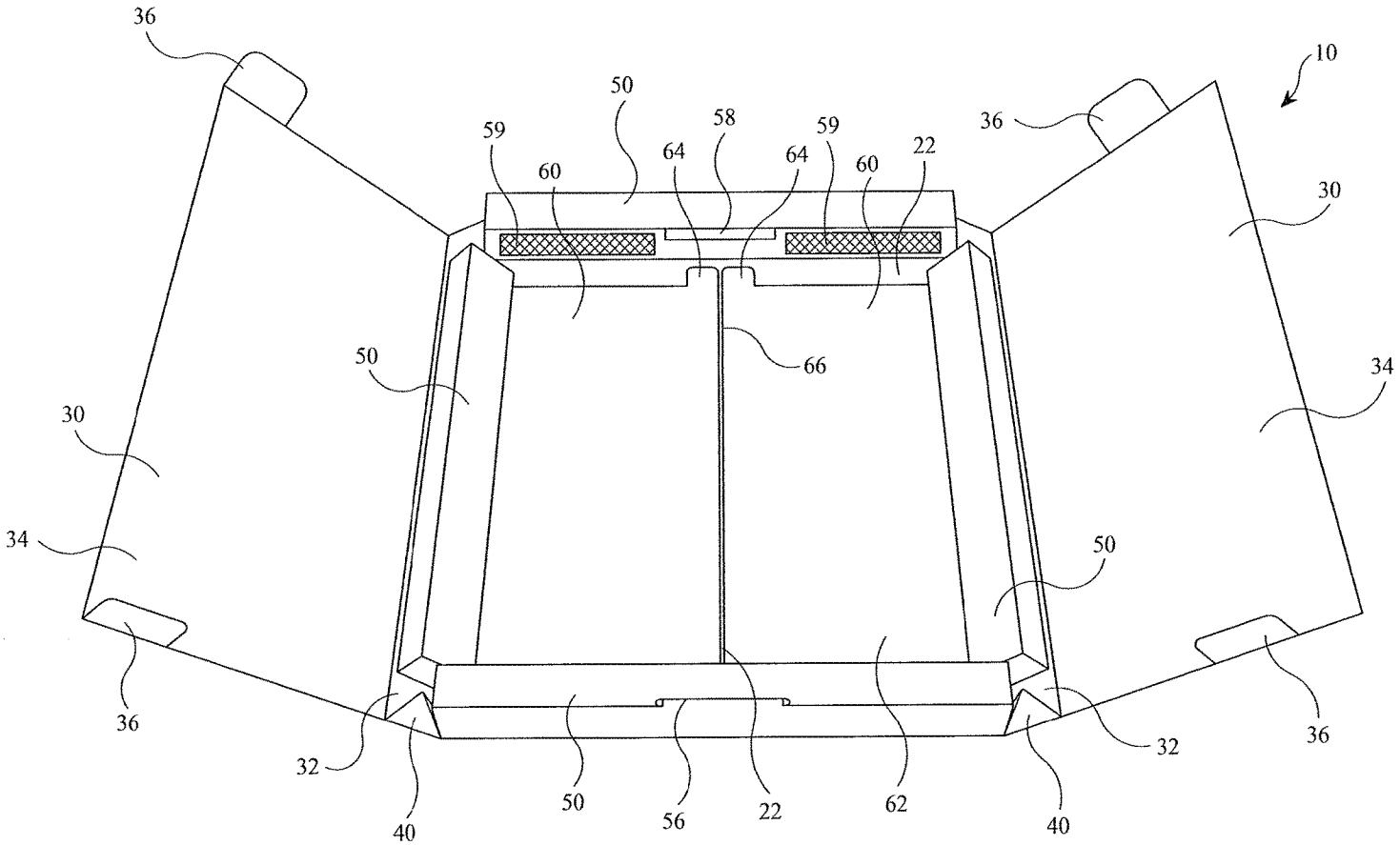
FIG. 10 shows a portion of a partially-assembled package according to some embodiments.
Figure 11:
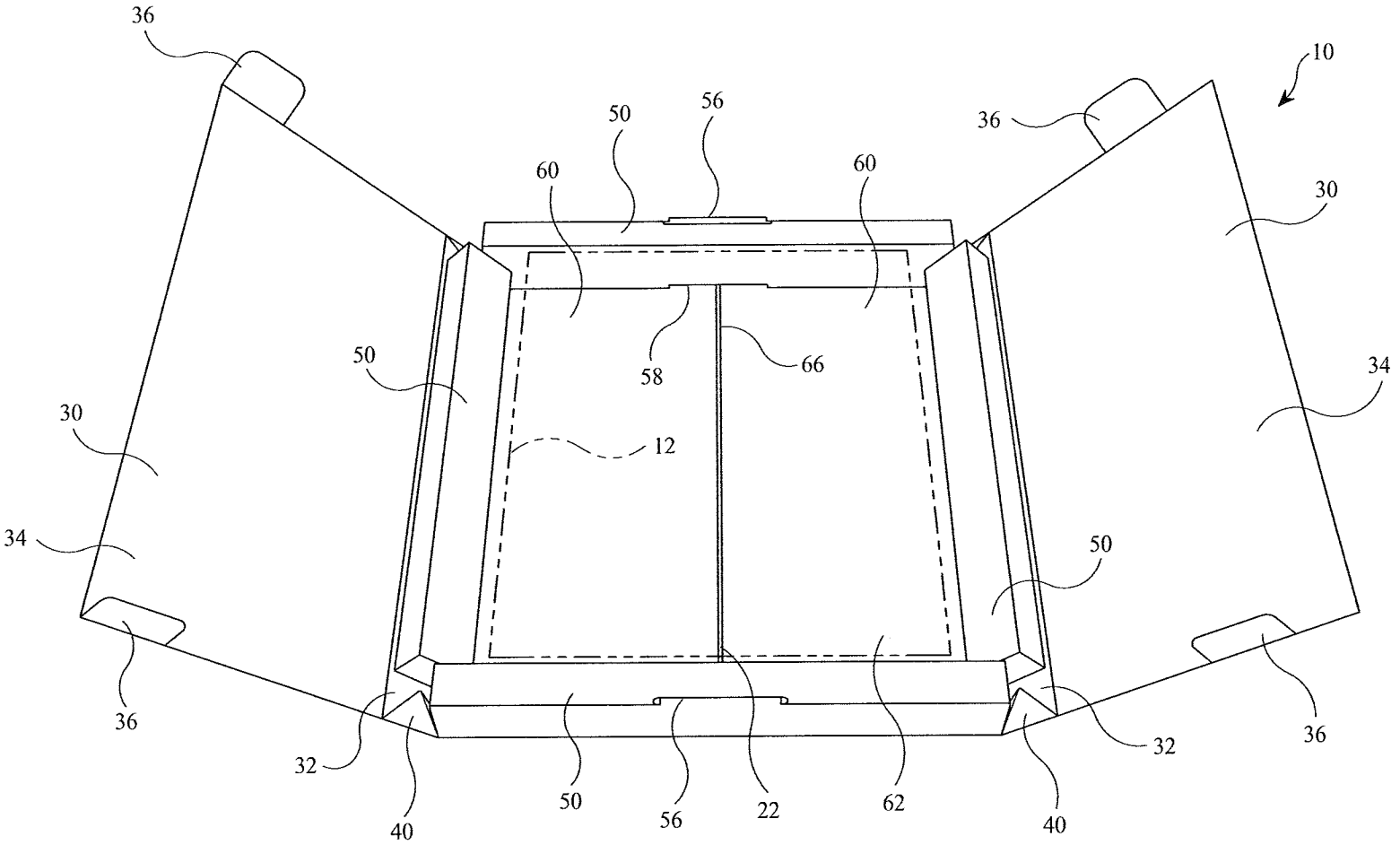
FIG. 11 shows an interior portion of a package according to some embodiments.

In some embodiments, cushioning cells 50 may be formed from each of the layouts. For example, the layout for outer box 20 may form two cushioning cells 50 and the layouts for inserts 60 may each form one cushioning cell 50. As shown in FIGS. 7 and 8, for example, cushioning cell 50 may be formed by folding side portions 52 over into a rectangular prism. A side portion 52 may be formed into a rectangular prism on each side of cushioning cell (see FIG. 8). In some embodiments, the portion of the layout next to side portion 52 (i.e., an end of outer box 20 or insert 60) may then be folded over to form cushioning cell 50, as shown, for example, in FIGS. 8 and 9. Before folding the cushioning cell 50 over for the last time, a material 55 may be inserted into cushioning cell, as shown in FIG. 9. The last adhesive portion 59 will adhere to base 22 for cushioning cells 50 of outer box 20 and to supporting portion 62 for cushioning cells 50 of inserts 60. Prior to closing cushioning cells 50 on outer box 20, inserts 60 are placed in the proper position over base 22 so that tabs 64 are aligned with slots 58, as shown, for example, in FIG. 10. When both cushioning cells 50 of outer box 20 have been closed, tabs 64 will be within slots 58, as shown, for example, in FIG. 11.

Figure 12:
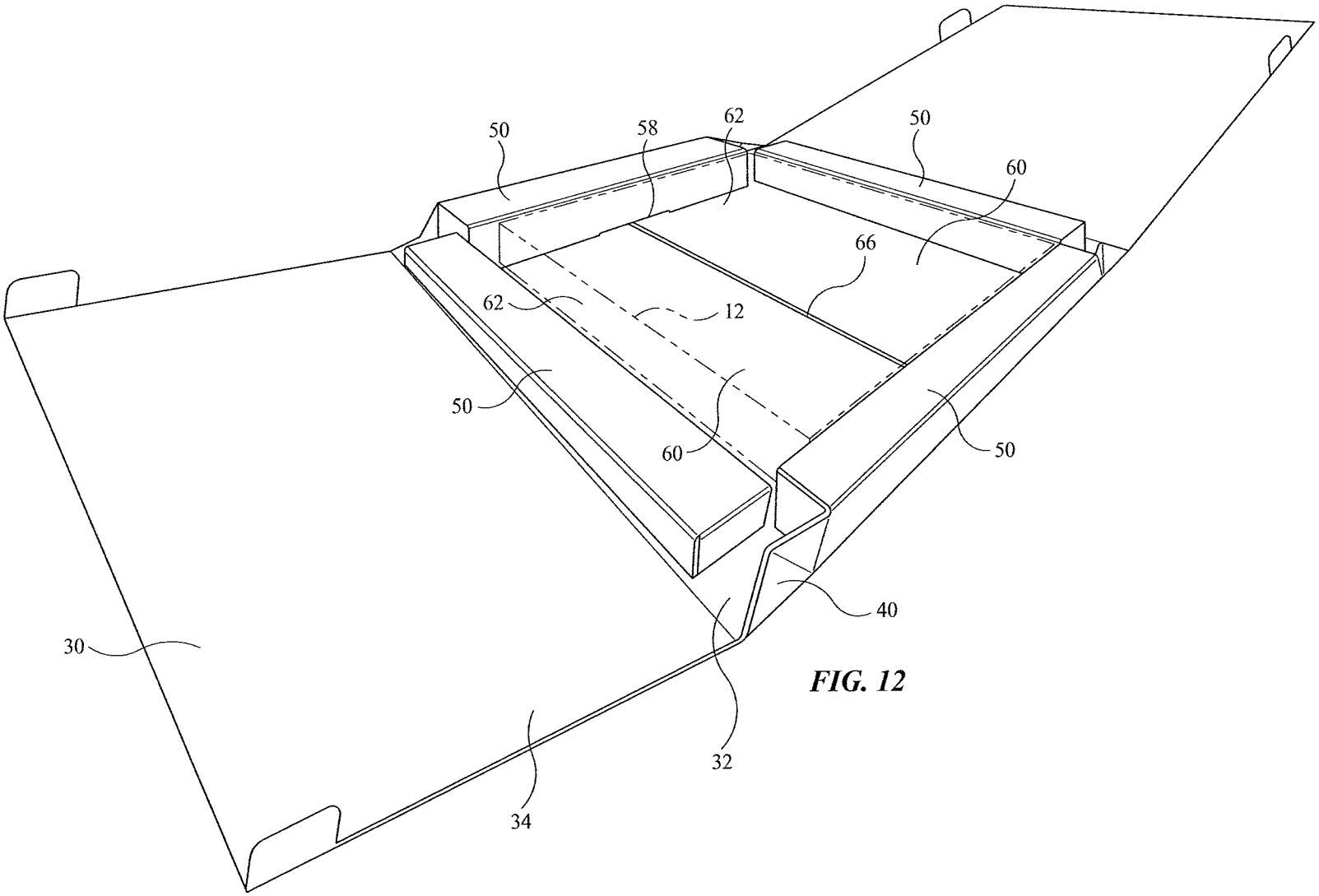
FIG. 12 shows an interior portion of a package according to some embodiments.
Figure 13:
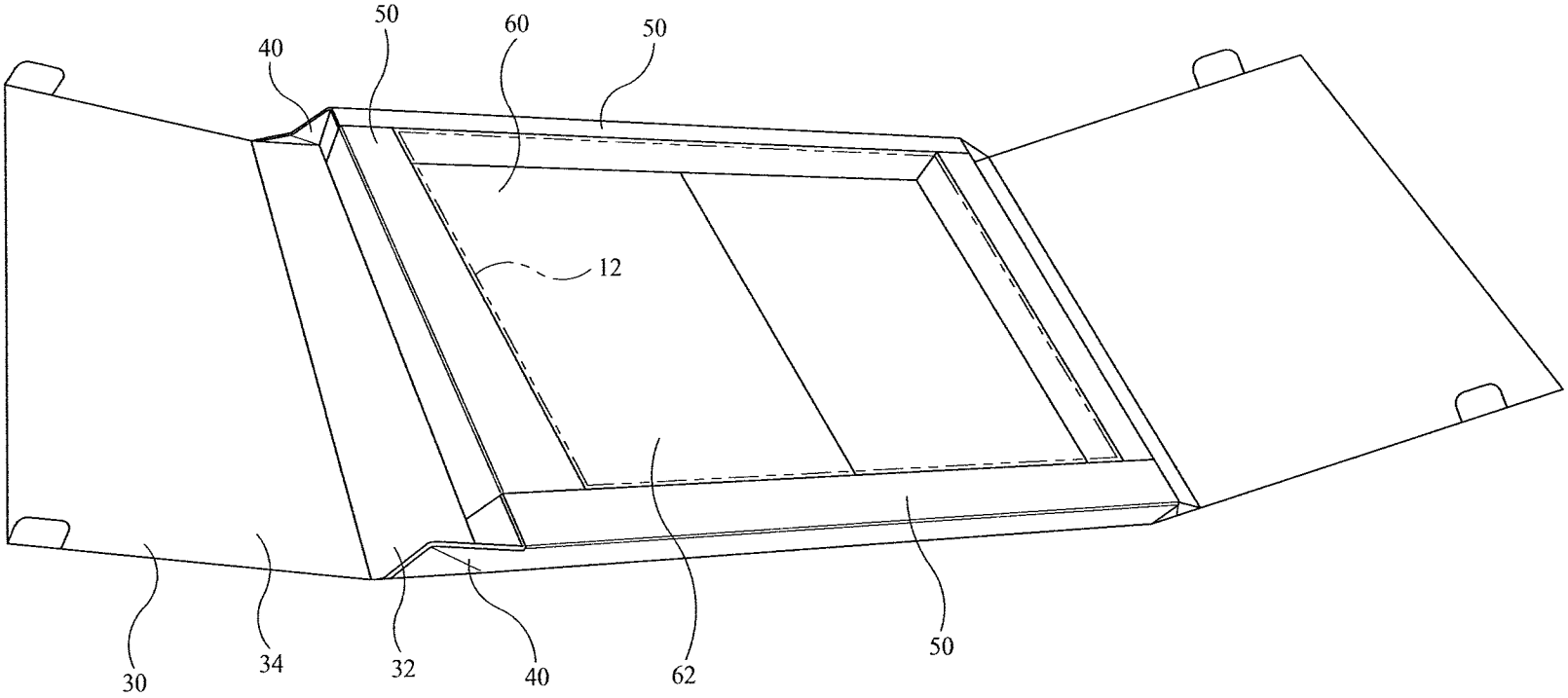
FIG. 13 shows a portion of a partially-assembled package according to some embodiments.
Figure 14:
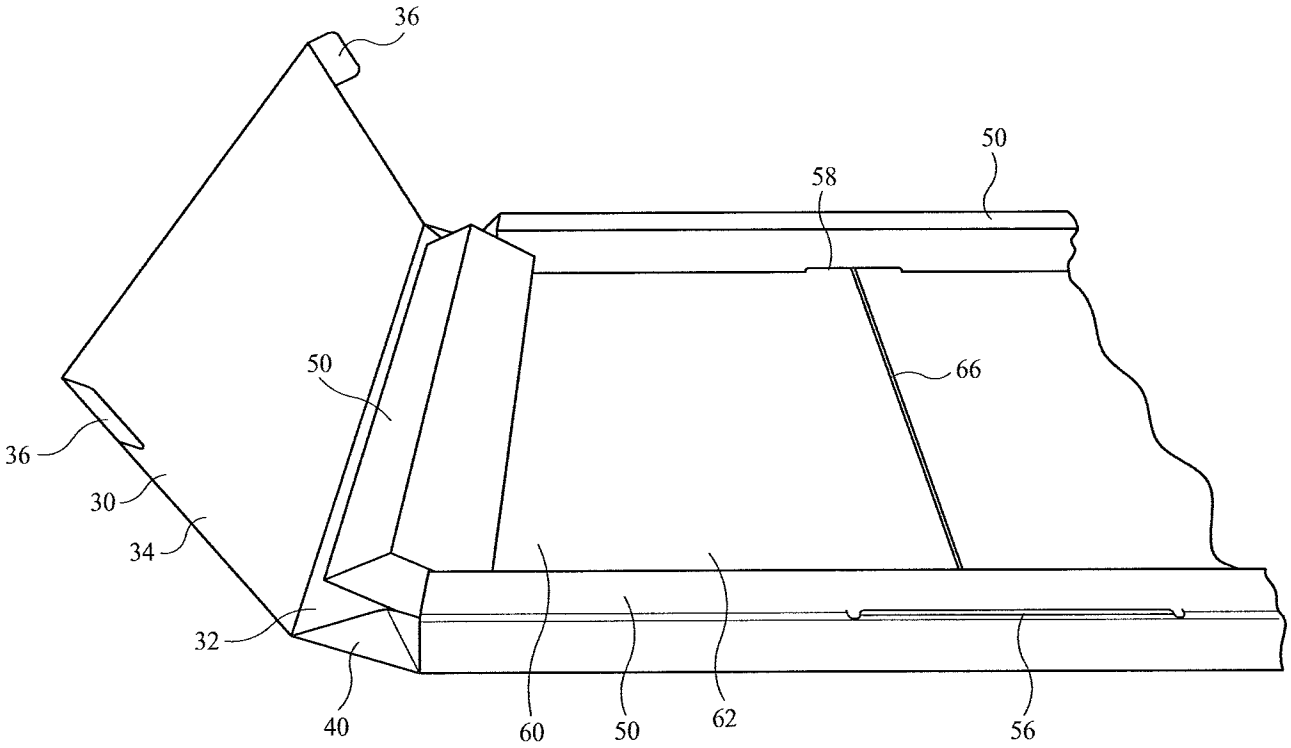
FIG. 14 shows a portion of a partially-assembled package according to some embodiments.

In some embodiments, gusset 40 may be folded inwards to facilitate opening and closing of flaps 30, as shown, for example, in FIG. 12. Each of the gussets 40 may be folded in this manner. In some embodiments, cushioning cell 50 of insert 60 may then be aligned with a boundary between base 22 and side portion 32, as shown, for example, in FIG. 13. In some embodiments, this alignment also aligns the cushioning cell 50 of insert 60 with cushioning cells 50 of outer box 20 (see FIG. 13). Cushioning cell 50 of insert 60 may then be attached to side portion 32, as shown, for example, in FIG. 14. In some embodiments, cushioning cell 50 is attached to side portion 32 with an adhesive (e.g., double-sided adhesive). Each of the inserts 60 may be attached to outer box 20 in this manner.

While the manufacture of package 10 has been described in a particular order, the process may be done in a different order. Once all inserts 60 have been attached to outer box 20, package 10 is ready to be used. In some embodiments, after package 10 is complete, item 12 may be placed within package 10 and flaps 30 may be folded over item 12 to close package 12.

Figure 15:
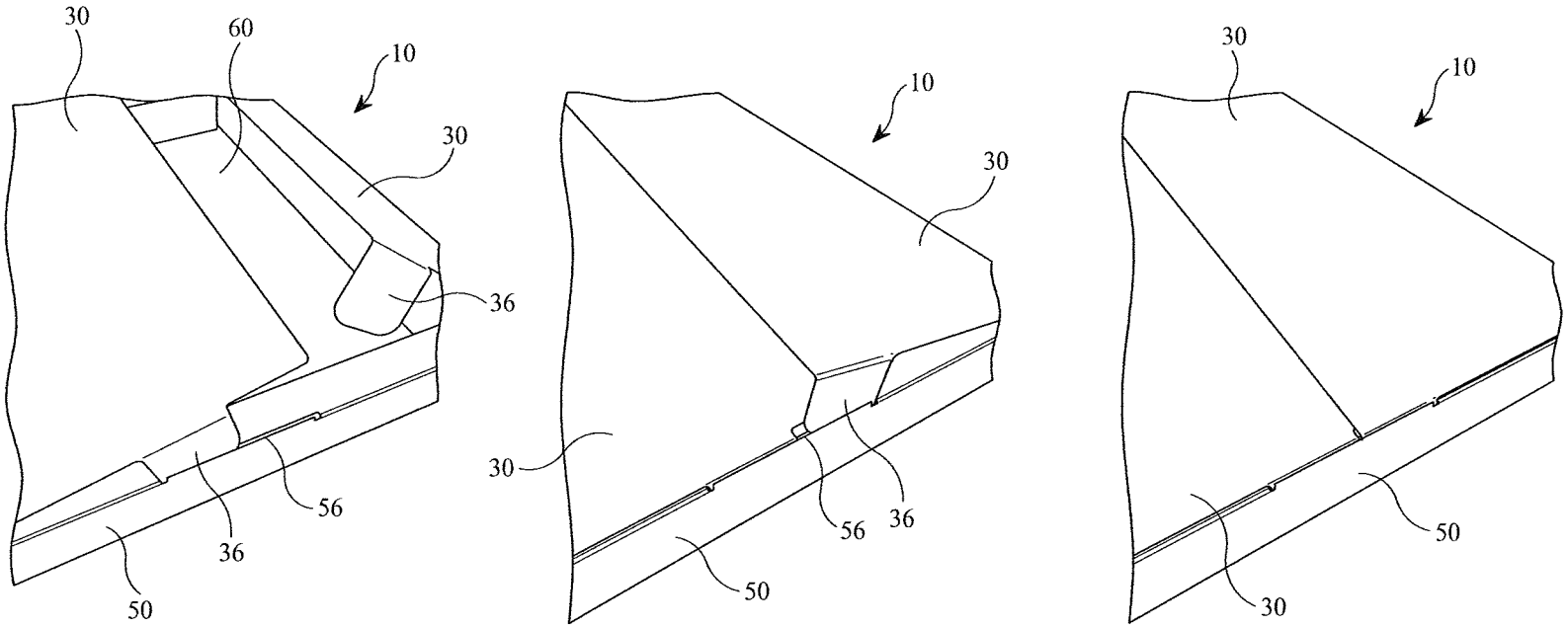
FIG. 15 shows a package in a closed configuration according to some embodiments.

In some embodiments, package 10 is closed as shown, for example, in FIG. 15. In some embodiments, one of the flaps 30 is first closed. Tabs 36 on each side of flap 30 are inserted into slots 56. In some embodiments, the other flap 30 may then be closed and the tabs 36 on each side of flap 30 inserted into slots 56. In some embodiments, flaps 30 overlap with each other, as discussed above. This may help protect item 12 by keeping dust and other debris out of package 10.

Figure 16:
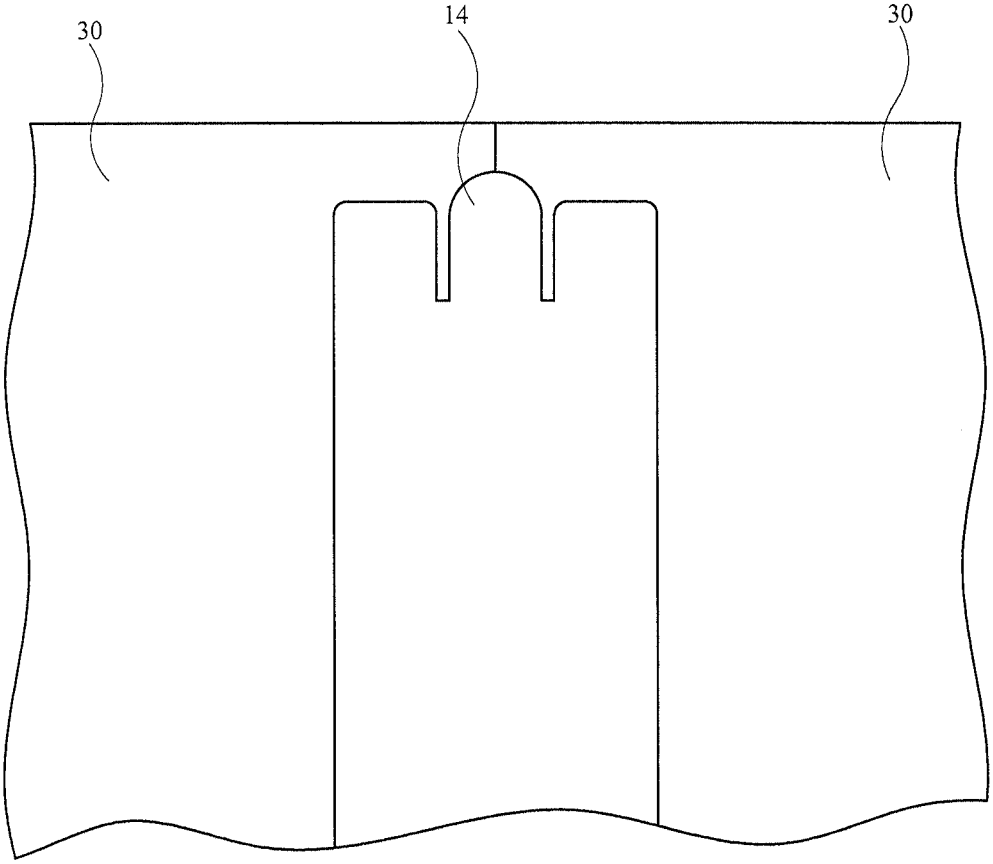
FIG. 16 shows a package in a closed configuration according to some embodiments.

In some embodiments, an adhesive 14 is included over each of the flaps 30 to keep package 10 closed, as shown, for example, in FIG. 16. In some embodiments adhesive 14 comprises two adhesive portions, one for each flap 30. In some embodiments adhesive 14 comprises two adhesive portions separated by a non-adhesive portion. In some embodiments, adhesive 14 includes a ripcord in the non-adhesive portion. When a user is ready to open package 10, the user may pull on the ripcord to detach flaps 30 from each other. Flaps 30 may then be opened to expose the interior of package 10.

Figure 17:
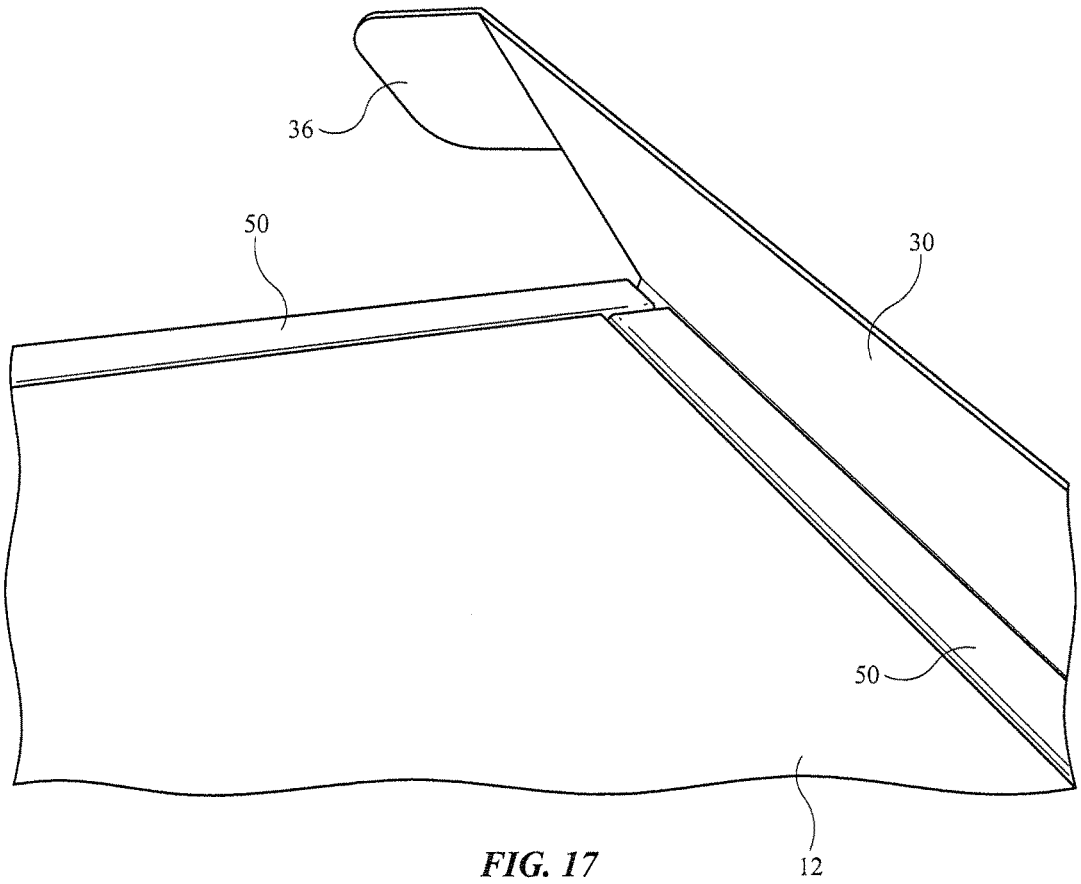
FIG. 17 shows an item in a package according to some embodiments.

As shown, for example, in FIG. 17, an item 12 may be included in package 10. In some embodiments, the weight of item 12 assists in the functioning of package 10. For example, the weight of item 12 on top of supporting portion 62 may keep inserts 60 from moving. Thus, when the user opens package 10, flaps 30 pull inserts 60 apart from each other, increasing the width of gap 66. The weight of item 12 keeps inserts 60 in this position. As a result, flaps 30 remain open and substantially lay flat. Accordingly, package 10 remains open and flaps 30 do not interfere with the view of item 12. While the weight of item 12 keeps package 10 open, the weight is not so great that the user cannot easily open flaps 30 or close flaps 30 to return inserts 60 to the closed configuration.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein. For example, in some embodiments, only one flap 30 and one insert 60 may be used. In addition, insert 60 may be attached to flap 30 at a different location of flap 30 (i.e., not at side portion 32). In some embodiments, insert 60 may not include cushioning cells 50. Other variations are also within the scope of this disclosure.

The detailed description section is intended to be used to interpret the claims. The summary and abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A package comprising:

an outer box having a base panel and a first flap extending from the base panel, the first flap configured to open and close the package;

a second flap extending from the base panel opposite the first flap, the second flap configured to open and close the package;

a first insert panel disposed within the outer box, the first insert panel having a first end attached to the first flap and a second end disposed over the base panel, the first insert panel configured to support an item within the package; and a second insert panel disposed within the outer box, the second insert panel having a first end attached to the second flap and a second end disposed over the base panel, the second insert panel configured to support an item within the package, wherein the second end of the first insert panel is configured to slide relative to the base panel when the first flap is opened, wherein the first insert panel is configured to keep the first flap in an open position by friction between the first insert panel and the base panel, wherein the second insert panel is configured to move relative to the base panel when the second flap is opened, wherein the second insert panel is configured to keep the second flap in an open position by friction between the second insert panel and the base panel, and wherein the motion of the second insert panel when the second flap is opened is in an opposite direction as motion of the first insert panel when the first flap is opened.

2. The package of claim 1, wherein the outer box has two side cushioning cells, and wherein the first insert panel is disposed between the two side cushioning cells.

3. The package of claim 2, wherein the two side cushioning cells each define a slot near the base panel, wherein the second end of the first insert panel comprises a tab disposed within the slot of each of the two side cushioning cells, and wherein the slot guides the motion of the first insert panel.

4. The package of claim 2, wherein the two side cushioning cells comprise a rectangular prism.

5. The package of claim 2, wherein the two side cushioning cells comprise a honeycomb material.

6. The package of claim 1, wherein the first end of the first insert panel is attached to the first flap via an adhesive.

7. The package of claim 1, further comprising a cushioning cell disposed on a side portion of the first flap adjacent to the first insert panel.

8. The package of claim 1, wherein the first flap comprises a side portion forming a side of the outer box and a top portion forming a top of the outer box.

9. The package of claim 8, wherein the first end of the first insert panel is attached to the first flap at the side portion.

10. The package of claim 1, wherein the material of the package causes the first flap to be naturally biased toward a closed position, and wherein the friction between the first insert panel and the base panel contributes to overcoming the bias to keep the first flap in the open position.

11. The package of claim 1, wherein the first insert panel remains parallel to the base panel and slides on the base panel while the second end of the first insert panel slides relative to the base panel when the first flap is opened.

12. A package comprising:

an outer box having a base panel; and two insert panels disposed on the base panel at a bottom of the package and attached to the outer box, wherein the two insert panels move relative to the base panel when the package transitions between a first position wherein the package is closed and a second position wherein the package is open, wherein there is a larger gap between the two insert panels in the second position than in the first position, wherein the two insert panels comprise tabs, wherein the outer box defines slots that receive the tabs in the first position and the second position, and wherein the tabs move within the slots when the two insert panels move between the first position and the second position.

13. The package of claim 12, wherein there is no gap between the two insert panels in the first position.

14. The package of claim 12, further comprising an item disposed within the outer box.

15. The package of claim 14, wherein the item is disposed across the gap, and wherein a weight of the item keeps the two insert panels from moving relative to each other in the absence of applied outside force, thereby keeping the package from moving between closed and open.

16. The package of claim 12, wherein the two insert panels each comprise a width that is equal to a width of an interior of the package.

17. The package of claim 12, wherein the movement of the two insert panels relative to the base panel comprises the two insert panels sliding relative to the base panel.

18. A package comprising:

an outer box having a base panel;

two insert panels disposed over the base panel and attached to the outer box; and an item disposed within the outer box, wherein the two insert panels move relative to the base panel when the package transitions between a first position wherein the package is closed and a second position wherein the package is open, wherein there is a larger gap between the two insert panels in the second position than in the first position, and wherein the item is disposed across the gap, and wherein a weight of the item keeps the two insert panels from moving relative to each other in the absence of applied outside force, thereby keeping the package from moving between closed and open.

19. The package of claim 18, wherein the two insert panels are parallel to and in contact with the base panel in both the first position and the second position.

20. The package of claim 18, wherein the movement of the two insert panels relative to the base panel comprises the two insert panels sliding relative to the base panel.

* * * * *